US007779825B2

(12) United States Patent
Estrate

(10) Patent No.: US 7,779,825 B2
(45) Date of Patent: Aug. 24, 2010

(54) HIGH CAPACITY PAINTBALL HOPPERS AND LOADERS AND PAINTBALL FEEDER COMBINATIONS WITH QUICK DISCONNECT, PERMANENT AND INTEGRAL CONNECTION CONFIGURATIONS

(76) Inventor: Evan A. Estrate, 7901 Hill Park Ct., Lorton, VA (US) 22079

( * ) Notice: Subject to any disclaimer, the term of this patent is extended or adjusted under 35 U.S.C. 154(b) by 375 days.

(21) Appl. No.: 11/798,657

(22) Filed: May 16, 2007

(65) Prior Publication Data

US 2008/0053422 A1 Mar. 6, 2008

Related U.S. Application Data

(60) Provisional application No. 60/808,124, filed on May 25, 2006, provisional application No. 60/801,416, filed on May 19, 2006.

(51) Int. Cl.
*F41B 11/02* (2006.01)

(52) U.S. Cl. ..... 124/49; 124/51.1

(58) Field of Classification Search ..... 124/45, 124/49, 50, 51.1, 73, 74
See application file for complete search history.

(56) References Cited

U.S. PATENT DOCUMENTS 5,809,983 A * 9/1998 Stoneking ..... 124/50
6,722,355 B1 * 4/2004 Andrews, Jr. ..... 124/49
6,935,324 B2 * 8/2005 Watson et al. ..... 124/49
6,978,776 B2 * 12/2005 Hamilton ..... 124/51.1
7,000,603 B1 * 2/2006 Steenbeke ..... 124/45
7,077,118 B2 * 7/2006 Lewis ..... 124/45
7,191,773 B2 * 3/2007 Vincent ..... 124/49
7,216,641 B2 * 5/2007 Friesen et al. ..... 124/45
7,270,120 B2 * 9/2007 Broersma et al. ..... 124/51.1
2002/0059927 A1 * 5/2002 Woods, Sr. ..... 124/45

* cited by examiner

*Primary Examiner*—John Ricci
(74) *Attorney, Agent, or Firm*—John Richardson

(57) ABSTRACT

A range of High capacity paintball pod hopper or loader housings for use with conventional paintball gun with attached paintball feeder core egg housing. The pod hopper housing has an enclosed end and an open end in contact with the paintball feeder core egg housing and is arranged for gravity feed transfer of paintballs to the paintball gun firing chamber. The pod loader housing has an enclosed end and an open end in contact with the paintball feeder core egg housing and is arranged for power feed transfer of paintballs to the paintball gun firing chamber The pod hopper and pod loader housings are arranged for connections to the feeder core egg housings using (a) quick connector bayonets, and spring-loaded pin, and (b) permanently connected using glued or mechanical fasteners.

27 Claims, 16 Drawing Sheets

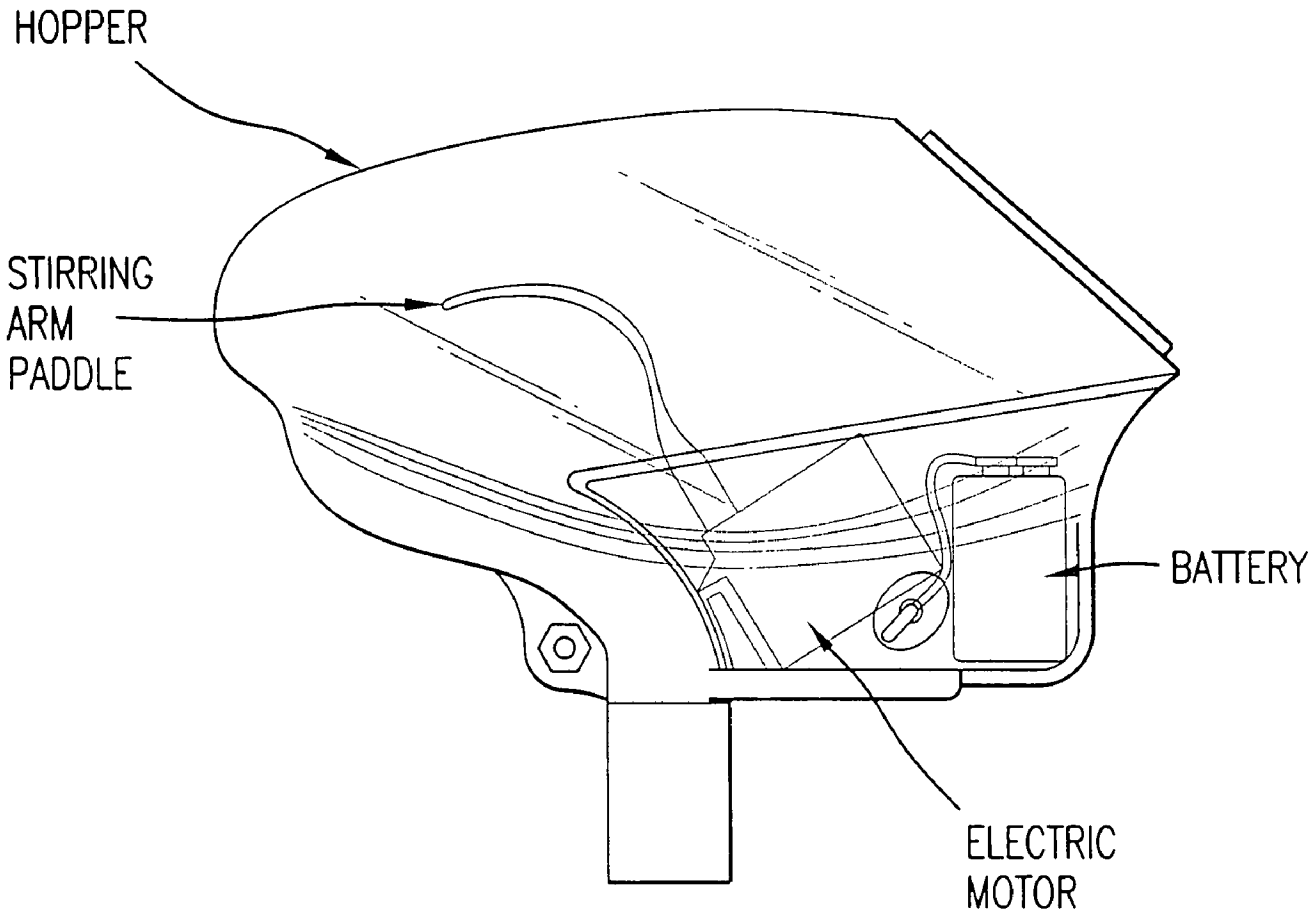
FIG. 14 -PRIOR ART

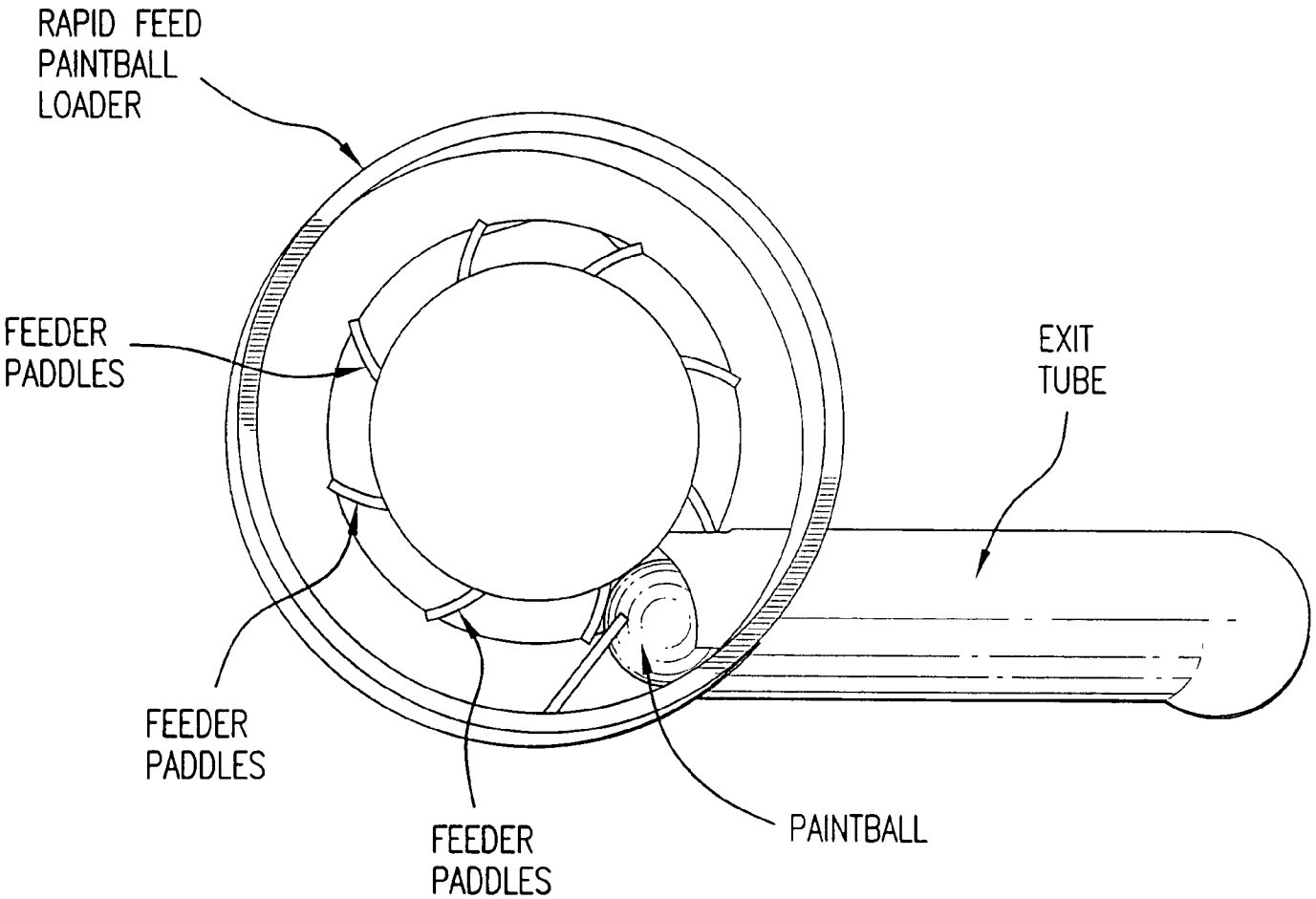
FIG. 15 -PRIOR ART

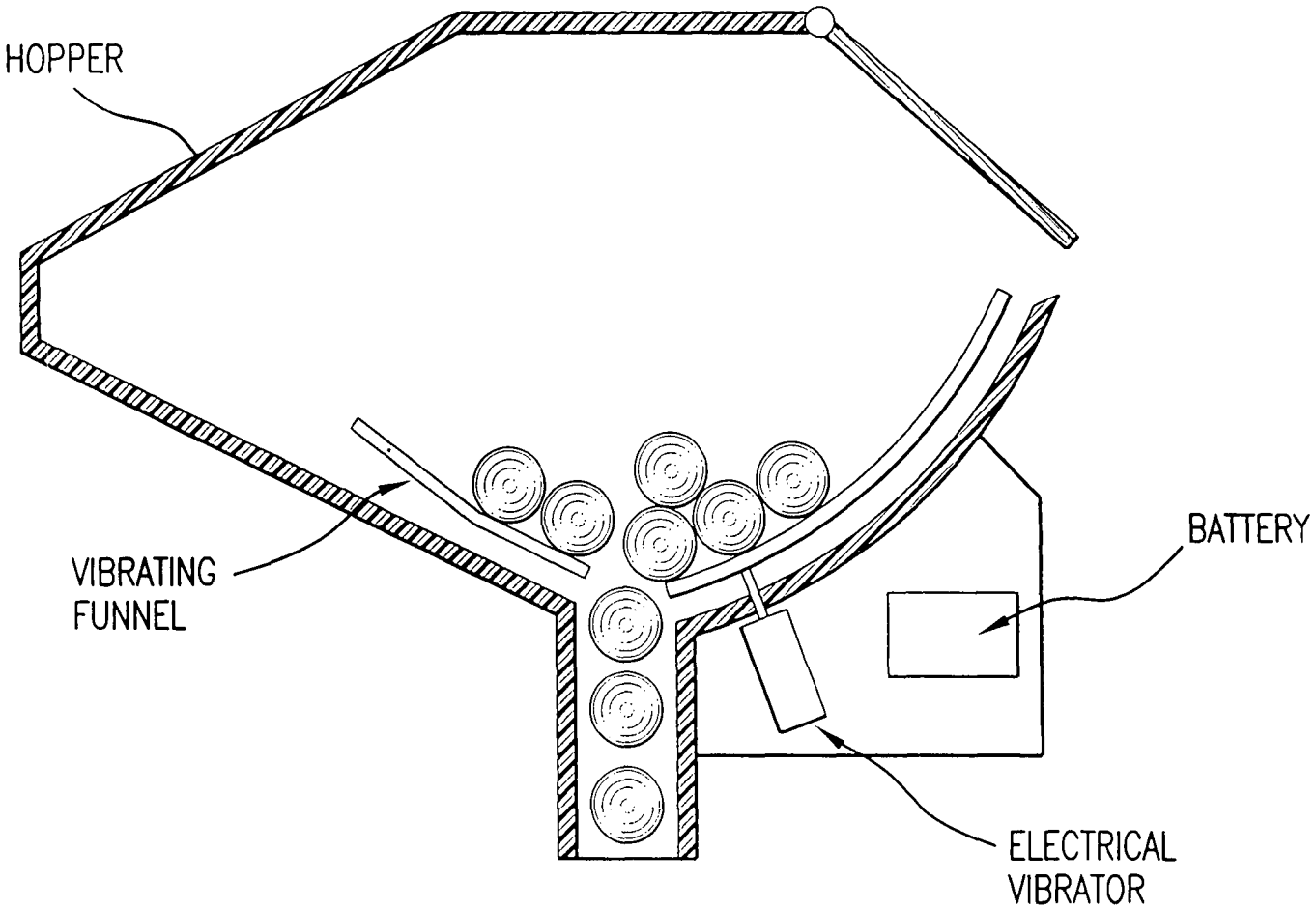
FIG. 16 - PRIOR ART

HIGH CAPACITY PAINTBALL HOPPERS AND LOADERS AND PAINTBALL FEEDER COMBINATIONS WITH QUICK DISCONNECT, PERMANENT AND INTEGRAL CONNECTION CONFIGURATIONS

This application claims priority to U.S. Provisional Patent Applications 60/801,416 filed May 19 2006, and 60/808,124, filed May 25 2006, the entire disclosures of which are incorporated by reference herein.

BACKGROUND OF THE INVENTION

The present invention generally relates to paintball guns, and more particularly relates to paintball loader and hopper combinations for dispensing uniformly-sized spherical projectiles such as frangible paintballs.

The game of Paintball is one in which two or more teams try to capture each other's flags and the players on each team are armed with compressed gas powered guns that shoot paintballs in the form of gelatin or plastic spherical balls or capsules that contain biodegradable colored liquids. During the game when a player is hit with a paintball from an adversary's gun, the paintball ruptures and leaves a colored mark on the hit player who then must retire from the game.

The operation of paintball games have grown more sophisticated with the use of semi-automatic paintball guns that sequentially fire individual paintballs as fast as the trigger can be repeatably pulled. The increased firing rate of semi-automatic paintball guns have lead to the use of bulk paintball storage hopper devices with paintball feeder mechanisms to meet the high firing rate demands of the game.

Based on existing paintball gun designs the paintball storage hopper includes a housing that is secured on the upper portion of the gun and the housing is shaped to hold a large quantity of paintballs. The base of the housing has an outlet tube through which the paintballs drop by the force of gravity and the outlet tube connects to an inlet tube located on the upper portion of the gun. The inlet tube directs each paintball into a firing chamber of the gun where the paintball is propelled outwardly from the gun under the action of compressed gas from the gas chamber attached to the lower portion of the gun.

The instant invention has reduced to practice a number of high capacity pod hopper and pod loader configurations adapted to be attached to existing designs of paintball egg (core) housings using gravity paintball feed systems and mechanical force feed systems with variable paintball feed such as manufactured by Ricochet. In particular, the instant invention has developed the said gravity feed system with no speed settings attached to Tippmann A5 and A7 guns with permanently attached high capacity pod hopper housings, and so called by the inventor as Hopper Models Nos. 1 and 2 respectively. In these configurations paintball loading is through a cap on the said core egg with combined paintball capacities upwards of 400. In addition, the invention has reduced to practice three further versions incorporating the said mechanical force paintball feed systems, wherein so called Hopper Model Nos. 3 has fixed delivery speed of 15 balls per second with total combined paint capacities dependant on the number of pod housings of upwards of 600 balls, Hopper Model No 4, also identified as "Impact" the same as the said Model No. 3 with a rated ball feed range of between 24 and 35 balls per second and made form high impact plastic, hence the name "Impact", Hopper Model No. 5, the same as Model No. 4, except with a material change to carbon fiber, and called "Pursuit". This range of paintball pod hopper or pod loader configurations in addition to further embodiments disclosed in later sections of the specification all in conjunction with paintball feeder core egg capacities provide a range of paintball enhanced capacities that provide the user with significant game advantages and has been given by the inventor the collective name of the "Pinokio" series of paintball high capacity pod hoppers and pod loaders.

The increased paintball firing capability of paintball guns is putting ever increasing demands on the players to quickly re-load the gun to stay in the game, and the purpose of the instant invention is to provide a range of increased capacity loaders that are readily adaptable to existing prior art paintball hoppers.

The instant invention addresses the need for improvements to Paintball Hoppers and Loaders that significantly enhance the player participation in paintball games using semi-automatic paintball guns by adapting existing paintball feeder hoppers.

The instant invention discloses design embodiments wherein the means of attachment between the Paint Ball Feeder Egg and the novel High Capacity Paintball Hopper and Loader housings are in the form of quick connect/disconnect connections, permanent connections, and an integral structure whereby the High Capacity Hopper or Loader housing is integral with the Paintball Feeder Egg.

The High Capacity Hopper and Loader housings of the instant invention offer means to mount a Pod directly to the at the forward and rearward ends of the nose of existing designs of Paintball Feeder Egg structures, by means of a multiplicity of quick release connections, such as bayonet fittings with ⅙ turn, ¼ turn, ½ turn and full turn, and other quick connection means such as screwed, taper screwed, spring-loaded ball bearing, eccentric rod, and other connectors used for example for interchangeable camera lenses connections. In addition the instant invention also discloses permanent mounting means for High Capacity Hopper and Loader housings to mount a Pod directly to the at the forward and rearward ends of the nose of existing designs of Paintball Feeder Egg structures, by methods such as gluing, sonic welding, ring clips, mechanical fasteners, etc.

The range of High Capacity Hopper housings is based upon gravity feed paintball gun systems, and the range of High Capacity Loader is based upon power feed paintball gun systems, wherein both these arrangements provide the paintball gun user with instant availability of upwards of 600 paintballs without re-loading, as compared to the largest current models by any paintball feeder egg capacity by any manufacturer which are no greater than 200 paintballs.

BRIEF SUMMARY OF THE INVENTION

In the instant invention novel High Capacity Paintball Hopper is based on gravity feed of the paintballs to the paintball gun, and novel High Capacity Paintball Loader is based on power feeding of the paintballs to the paintball by means of a paddle wheel, vibrating, agitating mechanisms or other paintball power feed systems providing for variable feed speed settings. Such variable feed speed settings can be in the form of constant or 'no speed settings', force feed settings regulated at a constant rate of between 10 and 20 balls per second, and a force feed settings regulated by a user interface to set speed at between 15 and 100 balls per second.

In the instant invention there are a multitude of embodiments that encompass the use of either a plurality of High Capacity Hoppers in combination with Paintball Feeder Egg structures, or alternatively a plurality of High Capacity Loaders in combination with Paintball Feeder Egg structures.

In the instant invention the novel High Capacity Hoppers are also disclosed as High Capacity 'Pod' Hoppers, the novel High Capacity Loaders are disclosed as High Capacity 'Pod' Loaders, and the existing designs of Paintball Feeder structures are disclosed as Paintball Feeder 'Egg' structures. The instant invention allows for the user to choose from a range of high capacity pod hopper housings and high capacity loader housings for attachment to the paintball feeder core egg housing by means of quick disconnect mechanical fittings, using ⅙, ¼, ½ or full turn bayonet type fittings, or in the alternative spring-loaded pin, threaded screw, compression screw or equal mechanical fittings.

In a range of embodiments of the instant invention the said high capacity pod hoppers and pod loader housings are available in a plurality of sizes in the range of 120, 160, 180 and 200 paintballs, and wherein the total capacity available to the gun user combined with the paintball feeder egg core capacity of 200, would be 320, 360, 380, or 400 with a single mounted pod housing, and 440, 480, 500, 540, 560, or 600 paintballs, as discussed in detail in the following sections.

In one preferred embodiment of the instant invention an existing design of a Paintball Feeder Egg is adapted to receive a novel High Capacity Paintball Pod Hopper housing capable of holding in the range of 50 plus, 100 plus, 200 plus, 300 plus, or 400 plush paintballs, at the proximal forward facing barrel end of an existing design of Paintball Feeder Egg and which is capable of holding up to 200 plus paint balls.

This embodiment of the instant invention using an existing design of a Paintball Feeder Egg is further adapted to receive two novel High Capacity Paintball Pod Hopper housings each capable of holding in the range of 50 plus, 100 plus, 200 plus, 300 plus, or 400 plus paintballs, with one arranged at the proximal forward facing end of the Paintball Feeder Egg and another additional novel High Capacity Paintball Hopper housing arranged at the distal end of the Paintball Feeder Egg.

In yet a further preferred embodiment of the instant invention a plurality of novel High Capacity Paintball Pod Hoppers housings each capable of holding 50 plus, 100 plus, 200 plus, 300 plus or 400 plus paintballs, and are arranged at the distal end and the proximal ends of an existing designs of Paintball Feeder Egg.

In yet a further embodiment of the instant invention using an existing design of a Paintball Feeder Egg is further adapted to receive two novel High Capacity Paintball Pod Hopper housings each capable of holding in the range of 50 plus, 100 plus, 200 plus, 300 plus, or 400 plus paintballs, one arranged at the proximal forward facing end of the Paintball Feeder Egg and another additional novel High Capacity Paintball Pod Hopper housing arranged at the distal end of the Paintball Feeder Egg.

In yet a further preferred embodiment of the instant invention a plurality of novel High Capacity Paintball Pod Hoppers housings each capable of holding in the range of 50 plus, 100 plus, 200 plus, 300 plus, or 400 plus paintballs, and are arranged at the distal end and the proximal ends of an existing designs of Paintball Feeder Egg.

In yet another embodiment of the instant invention an existing design of a Paintball Feeder Egg is adapted to receive a novel High Capacity Paintball Pod Loader housing capable of holding 50 plus, 100 plus, 200 plus, 300 plus, or 400 plus paintballs, at the proximal forward facing barrel end of a Paintball Feeder Egg and which is capable of holding in the range of 200 plus paint balls.

In yet another embodiment of the instant invention using an existing design of a Paintball Feeder Egg is further adapted to receive two novel High Capacity Paintball Pod Loader housings each capable of holding in the range of 50 plus, 100 plus, 200 plus, 300 plus or 400 plus paintballs, one arranged at the proximal forward facing end of the Paintball Feeder Egg and another additional novel High Capacity Paintball Pod Loader housing arranged at the distal end of the Paintball Feeder Egg.

In yet a further preferred embodiment of the instant invention a plurality of novel High Capacity Paintball Pod Loaders housings each capable of holding in the range of 50 plus, 100 plus, 200 plus, 300 plus, or 400 plus paintballs, and are arranged at the distal end and the proximal ends of an existing designs of Paintball Feeder Egg.

In yet a further embodiment of the instant invention using an existing design of a Paintball Feeder Egg is further adapted to receive two novel High Capacity Paintball Pod Loader housings each capable of holding in the range of 50 plus, 100 plus, 200 plus, 300 plus or 400 plus paintballs, one arranged at the proximal forward facing end of the Paintball Feeder Egg and another additional novel High Capacity Paintball Pod Loader housing arranged at the distal end of the Paintball Feeder Egg.

In yet a further preferred embodiment of the instant invention a plurality of novel High Capacity Paintball Pod Loader housings each capable of holding in the range of 50 plus, 100 plus, 200 plus, 300 plus, 400 plus, or upwards of 600 paintballs, and are arranged at the distal end and the proximal ends of an existing designs of Paintball Feeder Egg.

In a particular embodiment of the instant invention one of a ⅙ turn, ¼ turn, ½ turn and full turn bayonet type quick connector is disclosed to facilitate quick attachment of the said novel High Capacity Pod Hoppers or Pod Loaders to the existing designs of Paintball Feeder Egg. In the alternative, mechanical attachment mounts in the form of spring-loaded pin, threaded screw, and compression coupling can be utilized.

In further particular embodiments of the instant invention a series of Adaptor structures are incorporated that connect the two or three of the said High Capacity Paintball Pod Hoppers or Pod Loaders in a variety of configurations that it can be connected to existing designs of Paintball Feeder Egg.

The said Adaptor structures can be arranged to connect to at least one of the forward proximal end of the said Paintball Feeder Pod Hoppers or Pod Loaders and at the distal rearward end of the Paintball Feeder Egg.

The materials from which the major components of the High Capacity Pod Hopper or Pod Loader housing, the quick-disconnect coupling between the said High Capacity Loader and the Paintball Feeder Hopper, and the range of Adaptor pieces for connecting the said High Capacity Pod Hoppers or High Capacity Pod Loaders to the existing Paintball Feeder Egg, can be selected from materials well known in the paintball art, such as plastic, hi-impact plastic, fiber glass, carbon fiber, aluminum or other equal types of material that have high tensile strength and light weight.

In a further preferred embodiment of the instant invention an existing design of a paintball gun having a Paintball Feeder Egg is adapted to an integral High Capacity Pod Hopper housing and is permanently connected at the proximal forward facing barrel end of a Paintball Feeder Egg, the said Pod Hopper and Paintball Egg combinations being capable of holding upwards of 600 paint balls.

In yet a further preferred embodiment of the instant invention an existing design of a Paintball Feeder Egg has two permanently connected High Capacity Paintball Pod Hopper housings, one said Hopper housing arranged at the proximal forward facing end of the Paintball Feeder Egg and another said Hopper housing arranged at the distal end of the Paintball Feeder Egg.

In yet a further preferred embodiment of the instant invention a plurality of novel High Capacity Paintball Pod Hopper housings each capable of holding 50 plus, 100 plus, 200 plus, 300 plus, 400 plus, and upwards of 600 paintballs, permanently extend at the distal end and the proximal ends of an existing design of Paintball Feeder Egg.

In yet a further preferred embodiment of the instant invention the said High Capacity Pod Hopper housing is secured and integral with the Paintball Feeder Hopper and is capable of holding upwards of 600 paintballs.

In yet a further preferred embodiment of the instant invention a plurality of novel High Capacity Paintball Pod Loader housings each capable of holding 50 plus, 100 plus, 200 plus, 300 plus, 400 plus, or upwards of 600 paintballs, permanently extend at the distal end and the proximal ends of an existing design of Paintball Feeder Egg.

In yet a further preferred embodiment of the instant invention the said High Capacity Loader housing is integral with the Paintball Feeder Egg and is capable of holding upwards of 600 paintballs.

The materials from which the major components of the High Capacity Pod Hopper and High Capacity Pod Loader housings, and the permanent connected to the Paintball Feeder Egg, can be selected from materials well known in the paintball art, such as plastic, hi-impact plastic, fiber glass, carbon fiber, aluminum or other equal types of material that have high tensile strength and light weight.

BRIEF DESCRIPTION OF THE DRAWINGS AND PHOTOGRAPHS

A: High Capacity Loader housing with Quick Connect/Disconnect Connections to Paintball Feeder Hopper.

B: High Capacity Loader Housing with Permanent Connections to Paintball Feeder Hopper.

Figure 9:
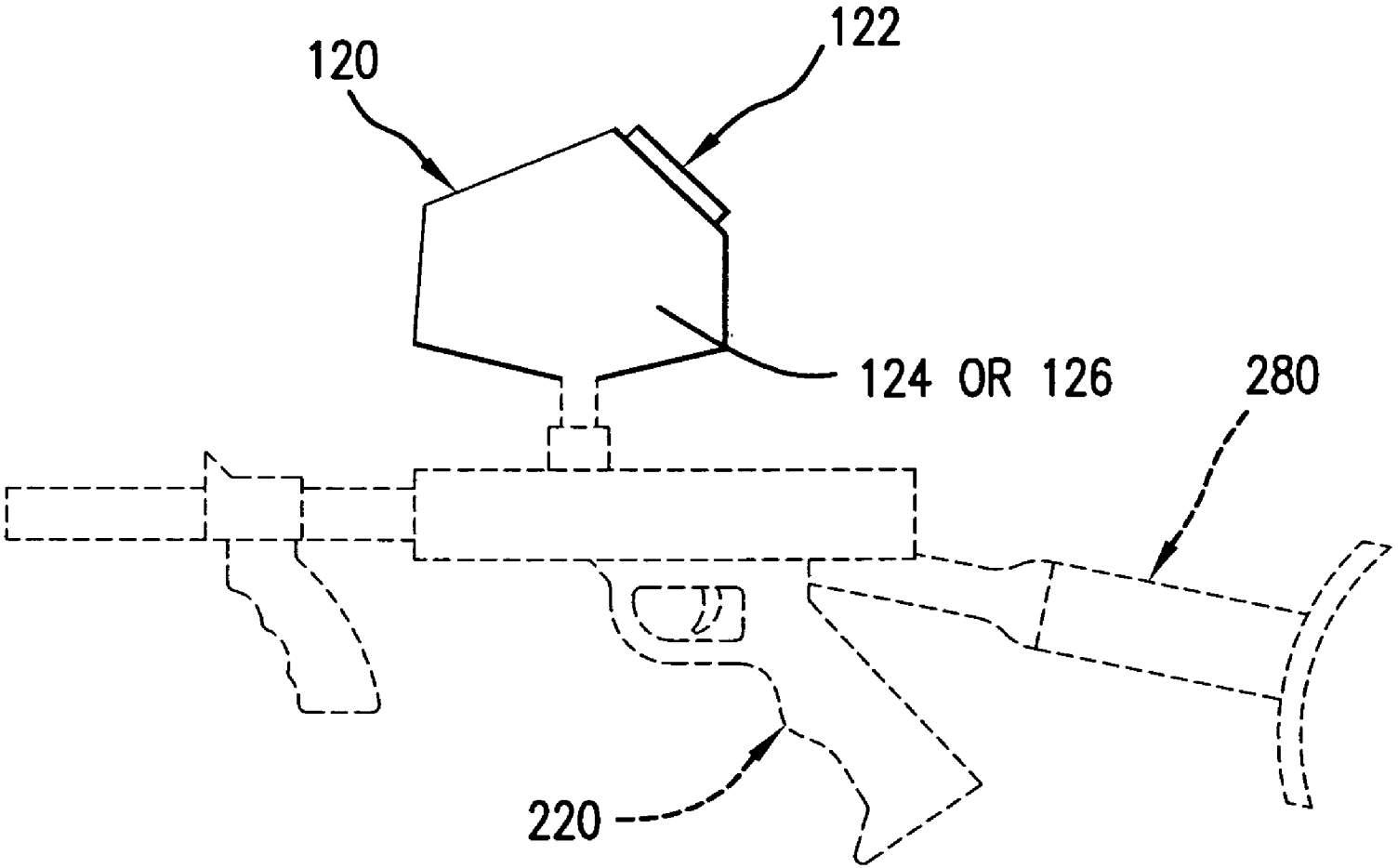

FIG. 9 is an example of existing prior art Paintball Gun with a Paintball Feeder Core Egg.

Figure 10:
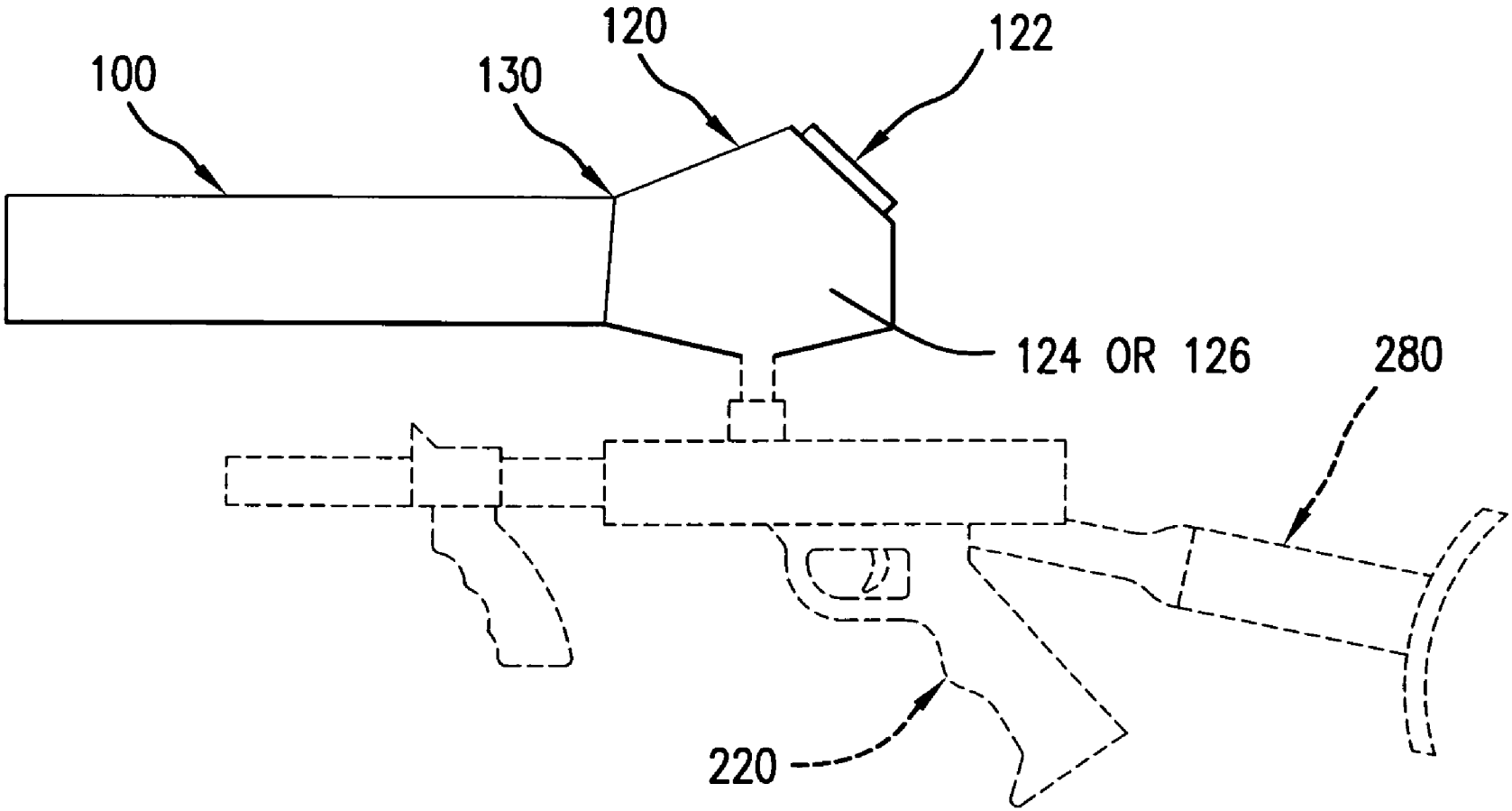

FIG. 10 is an embodiment of the present invention showing a Paintball Gun with Forward Facing High Capacity Paintball Pod Hopper or Pod Loader permanently integrally connected at the proximal end of an existing Paintball Feeder Core Egg.

Figure 11:
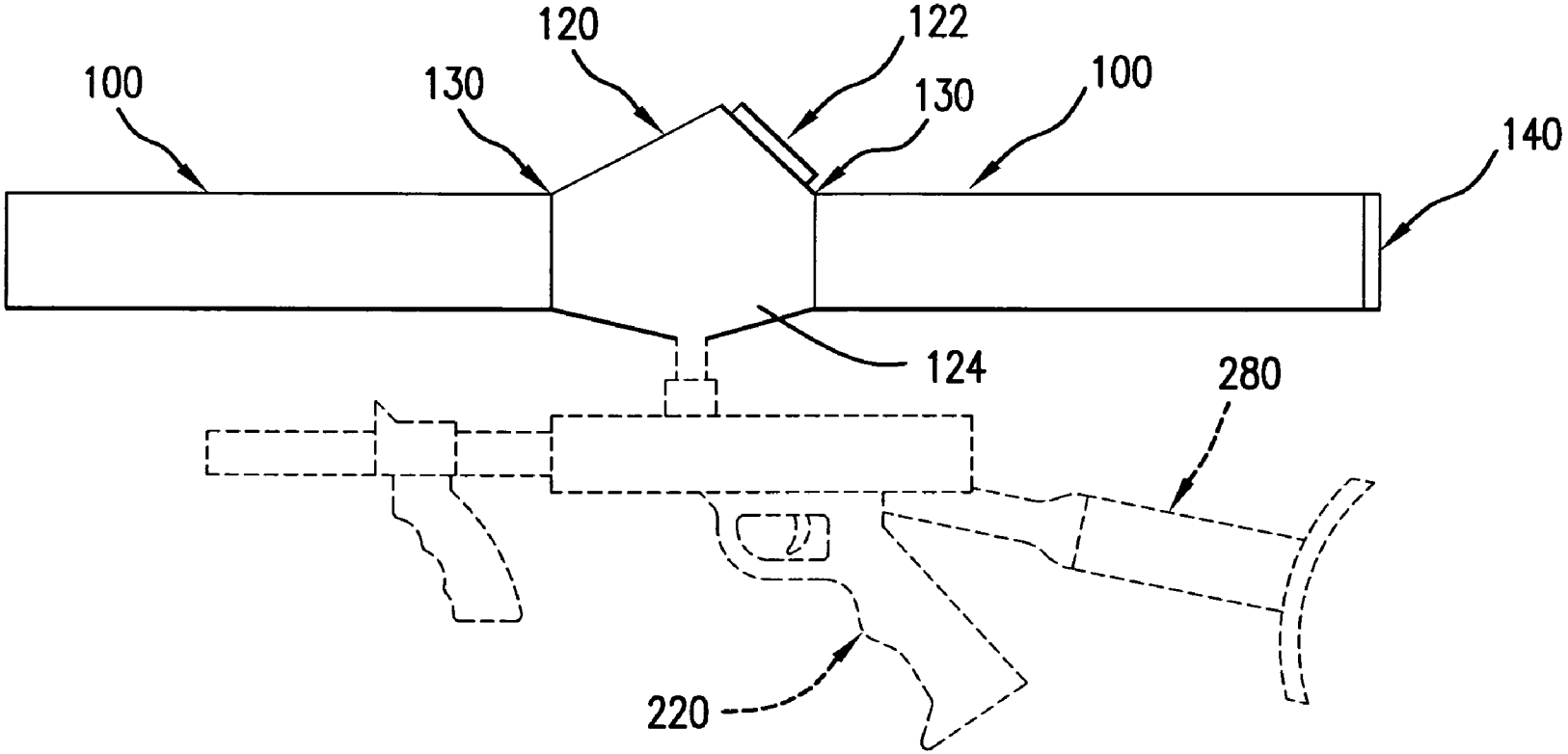

FIG. 11 is an embodiment of the present invention showing a Paintball Gun with forward facing High Capacity Paintball Pod Hoppers or High Capacity Pod Loaders integrally connected at the proximal end of a Paintball Feeder Core Egg and a further Rearward Facing High Capacity Paintball Pod Hopper or Pod Loader integrally connected at the distal end of a Paintball Feeder Core Egg and both permanently connected thereto.

C: High Capacity Pod Loader housing is integral to Paintball Feeder Egg.

Figure 12:
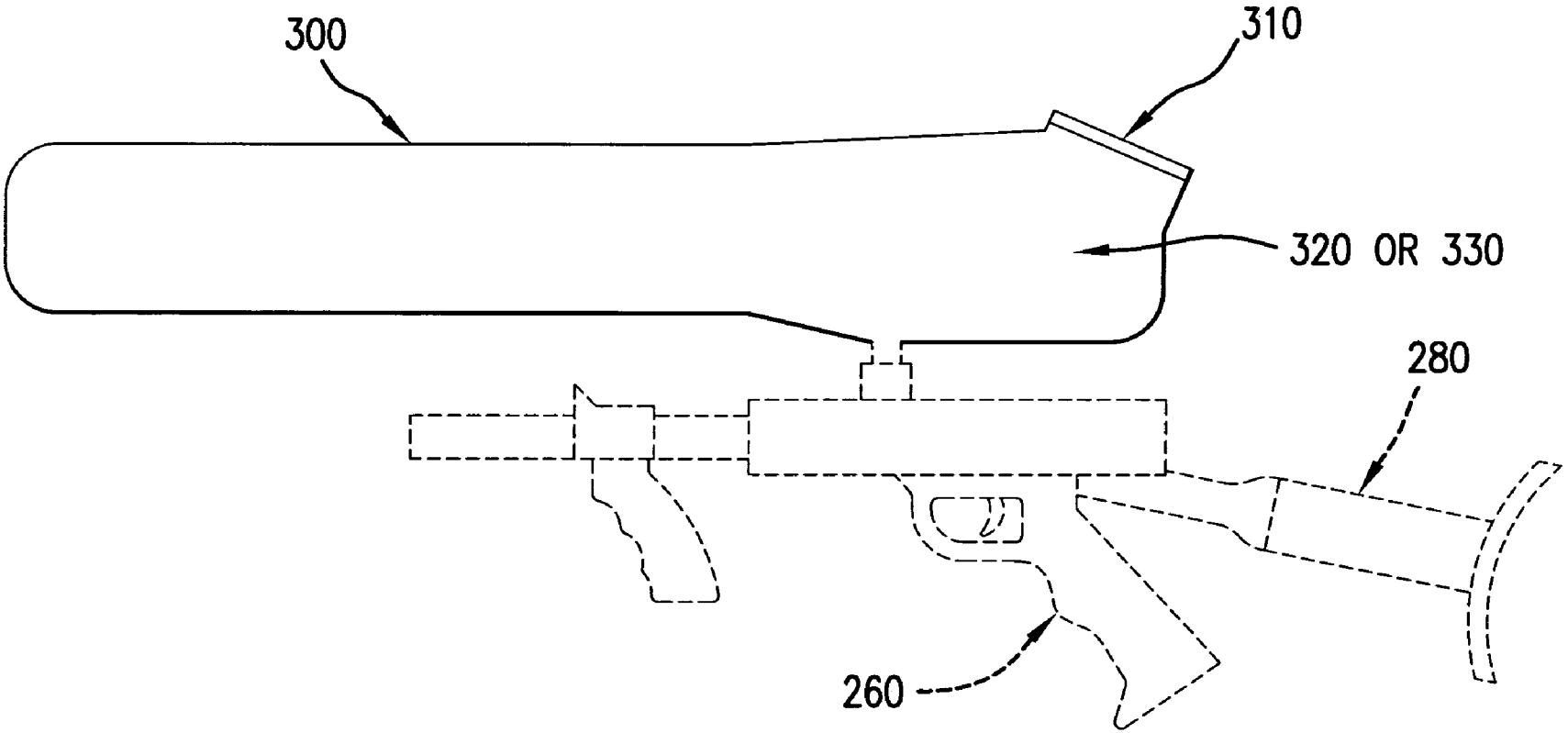

FIG. 12 is an embodiment of the present invention showing an integrally connected High Capacity Pod Loader combination based on paintball gravity feed concept.

Figure 13:
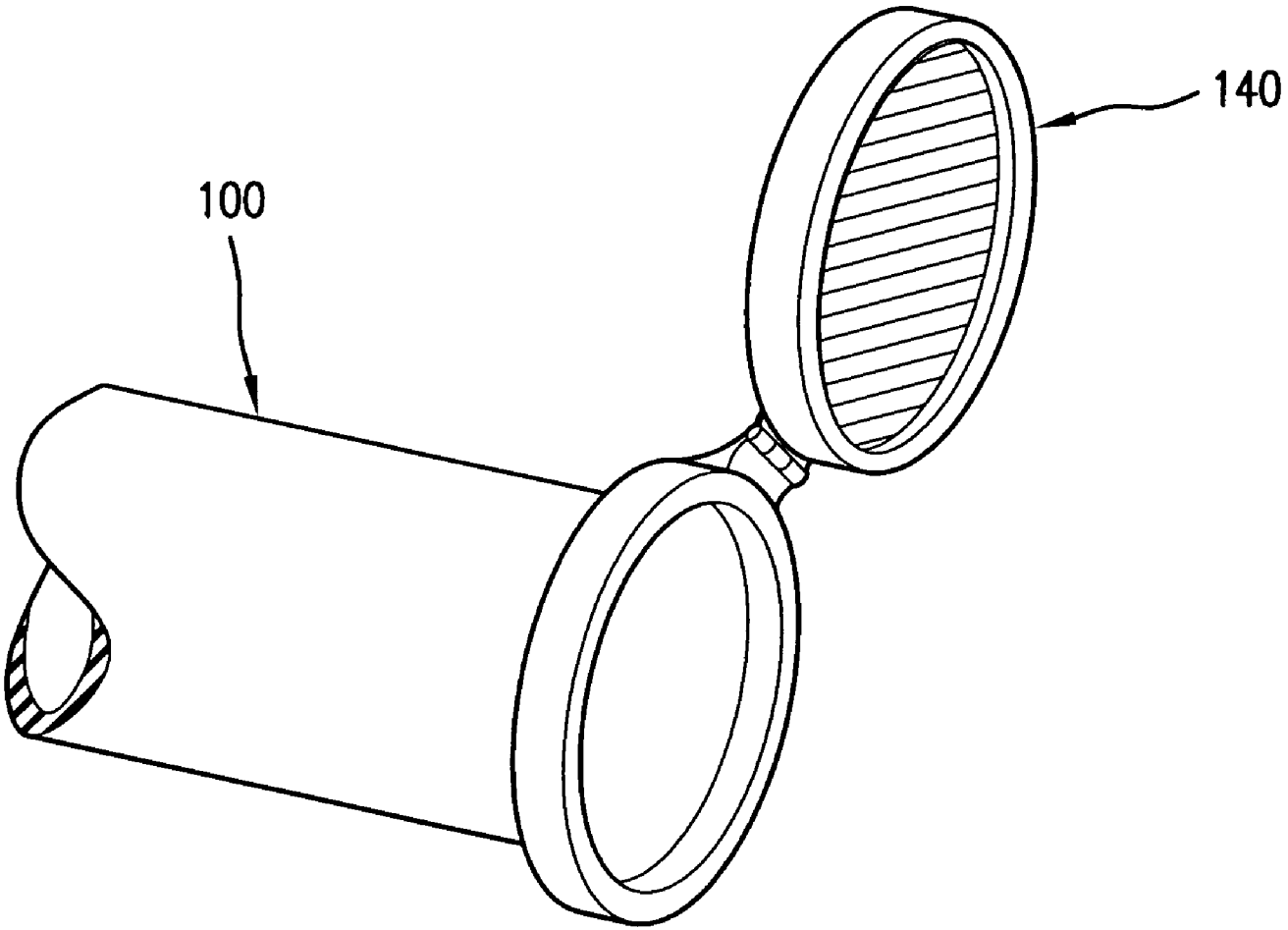

FIG. 13 shows the invention embodiment showing a 'flip' spring loaded High Capacity Pod Loader housing retainer enclosure cover.

FIG. 14 shows details of a typical stirring arm type prior art Paintball Feeder Core Egg mechanism.

FIG. 15 shows a Paintball Feeder Core Egg mechanism using rotary paddle type concept.

FIG. 16 shows a {Paintball Feeder Core Egg using a vibratory funnel concept.

DETAILED DESCRIPTION OF THE INVENTION

Reference Numeral Used in Drawings.

A: High Capacity Pod Hopper or Pod Loader Housing with Quick Connect/Disconnect connections to Paintball Feeder Hopper.

The table below lists all of the reference numerals employed in the Figures, and identifies the element designated by each numeral.

30 High Capacity Paintball Pod Hopper or Pod Loader Housing of the invention.

32 High Capacity Paintball Pod Hopper or Pod Loader Housing ⅙ turn, ¼ turn, ½ turn and full turn or equal quick connector of the invention.

34 An Adaptor piece of the invention for two High Capacity Paintball Pod Hopper or Pod Loader Housings in side-by-side or top-bottom configuration configurations.

36 High Capacity Paintball Pod Hopper or Pod Loader Housing 'flip' spring loaded retaining enclosure cover.

38 An Adaptor piece of the invention for three High Capacity Paintball Pod Hopper or Pod Loader housings in a regular triangular array.

40 An Adaptor piece of the invention for three High Capacity Paintball Pod Hoppers or Pod Loader housings in a horizontal array.

42 An example of existing prior art Paintball Gun assembly.

43 An example of existing art Gas Firing Tank Cylinder.

46 An example of existing prior art Paintball Feeder Egg structure.

48 An example of existing prior art Paintball Gun Gas Firing Cylinder

50 Arcuate shaped locking groove.

52 Locking lugs.

B: High Capacity Loader Housing with Permanent Connections to Paintball Feeder Hopper.

100 High Capacity Paintball Pod Hopper or Pod Loader Housing of the invention.

120 Typical Paintball Feeder Egg.

122 Typical Paintball Feeder Egg loading cover.

124 Typical Paintball Feeder Egg using prior art rotary paddle type mechanism for propelling the transfer of paintballs.

126 Paintball Feeder Egg using gravity or power force means for facilitating the transfer of paintballs.

130 Integral or secured fixed mechanical connection between High Capacity Pod Hopper or Pod Loader housing and Paintball Feeder Egg.

140 High Capacity Paintball Pod Hopper or Pod Loader loading 'flip' spring retaining enclosure cover.

220 An example of existing prior art Paintball Gun assembly.

260 An example of existing prior art Paintball Gun Hopper.

280 An example of existing prior art Paintball Gun Gas Firing Cylinder.

C: High Capacity Loader Housing is Integral to Paintball Feeder Hopper.

300 Integral High Capacity Paintball Pod Hopper arranged for gravity paintball feeding or High Capacity Pod Loader with vibrating paintball feeder with feed speed setting mechanism.

310 Integral High Capacity Paintball Pod Hopper or Pod Loader with 'flip' spring loaded retaining enclosure cover.

320 Paintball Feeder Egg using prior art rotary paddle type mechanism.

330 Paintball Feeder Egg using a paintball force feed type mechanism.

Figure 1:
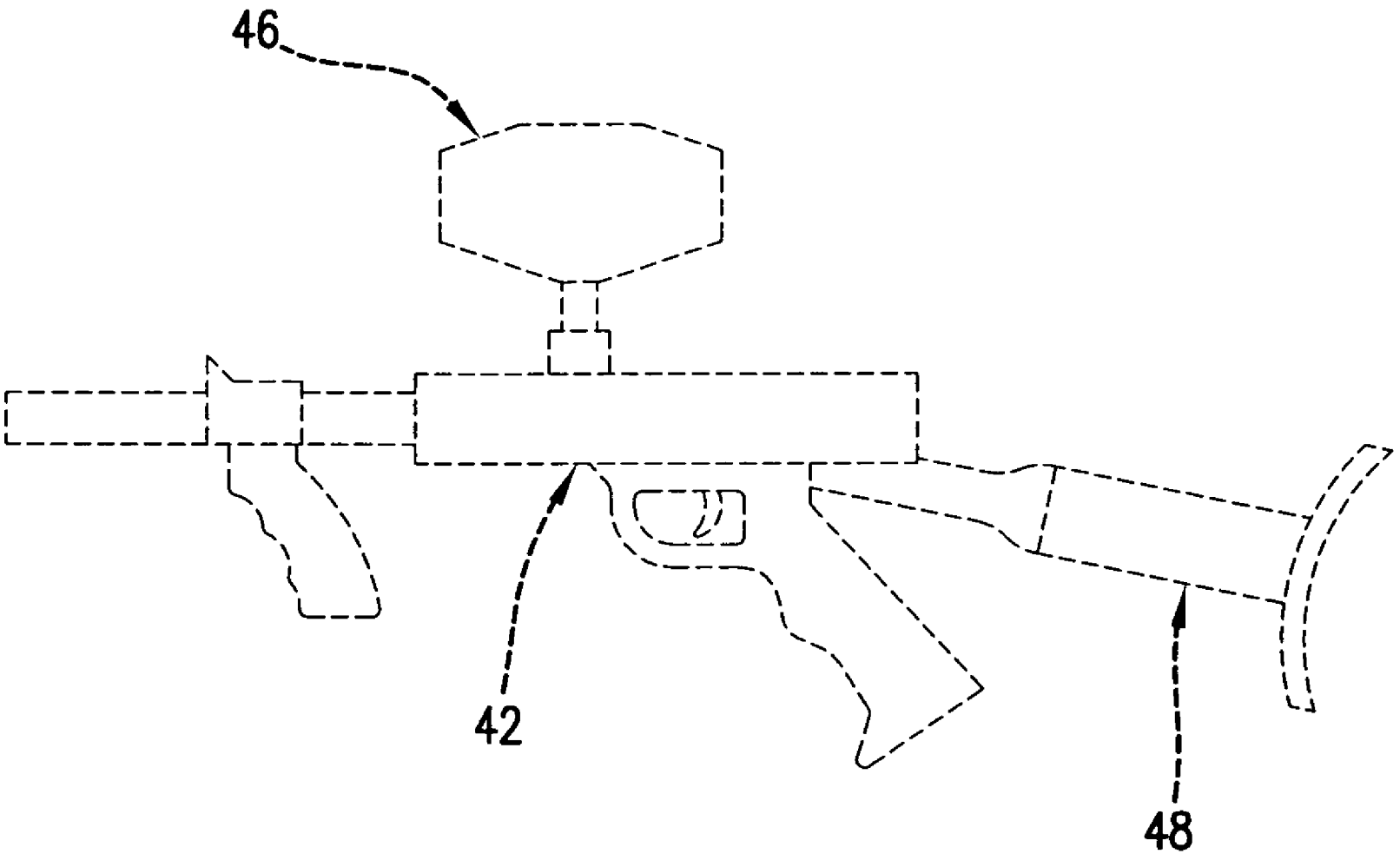
FIG. 1 is an example of existing prior art Paintball Gun with a Paintball Feeder Egg.

FIG. 1 shows a typical example of a Paintball Gun assembly 42 with a Paintball Feeder Egg structure mounted on top 46 and with an attached gas firing cylinder 48.

Figure 2:
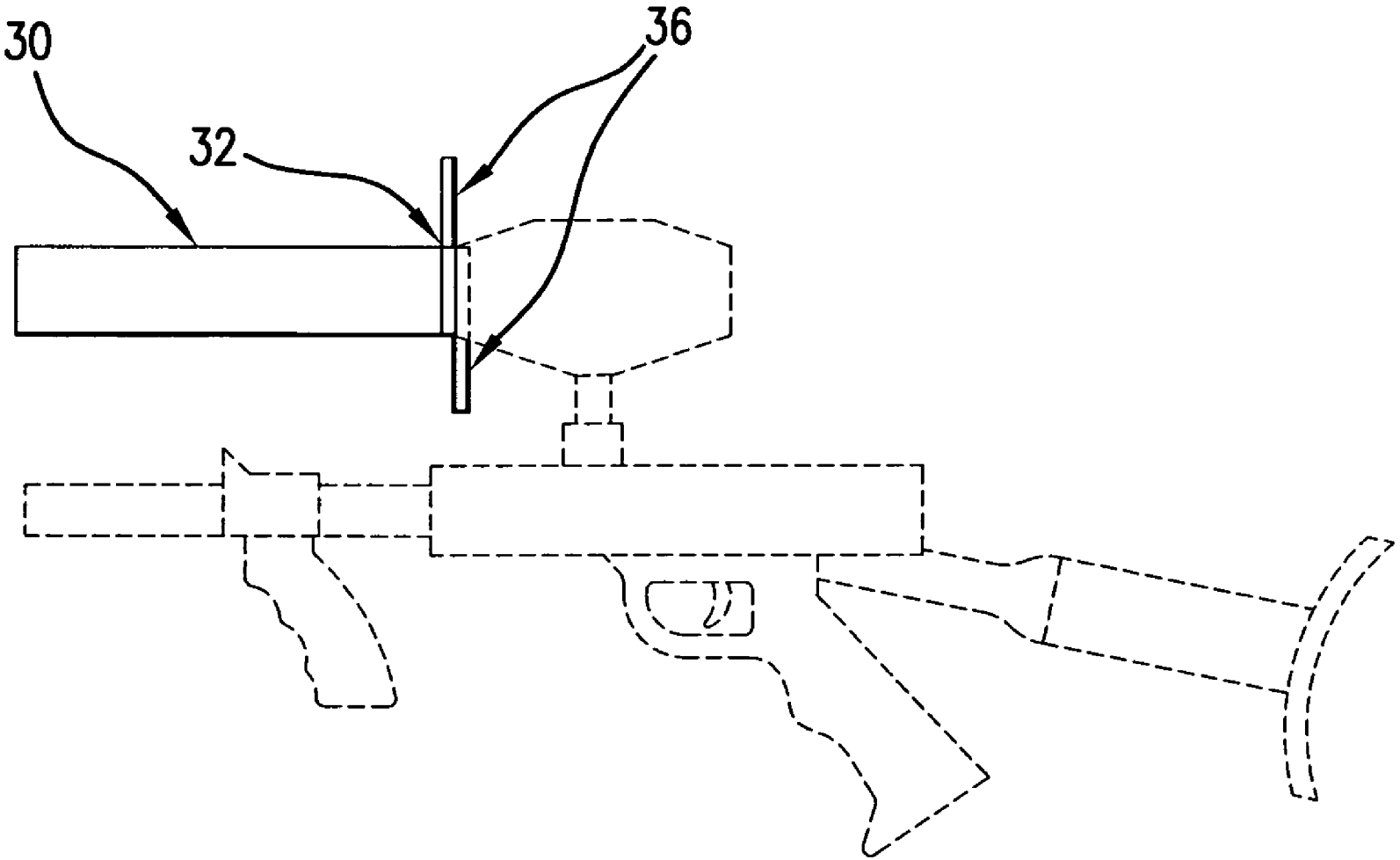
FIG. 2 is an embodiment of the present invention showing a Paintball Gun with Forward Facing High Capacity Paintball Pod Hopper or Pod Loader located at the proximal end of an existing Paintball Feeder Core Egg.

FIG. 2 shows an embodiment of the instant invention showing a High Capacity Pod Hopper or Pod Loader housing 30 connected to the proximal end of the Paintball Feeder Egg housing and a 'flip' spring loaded retaining enclosure 36.

Figure 3:
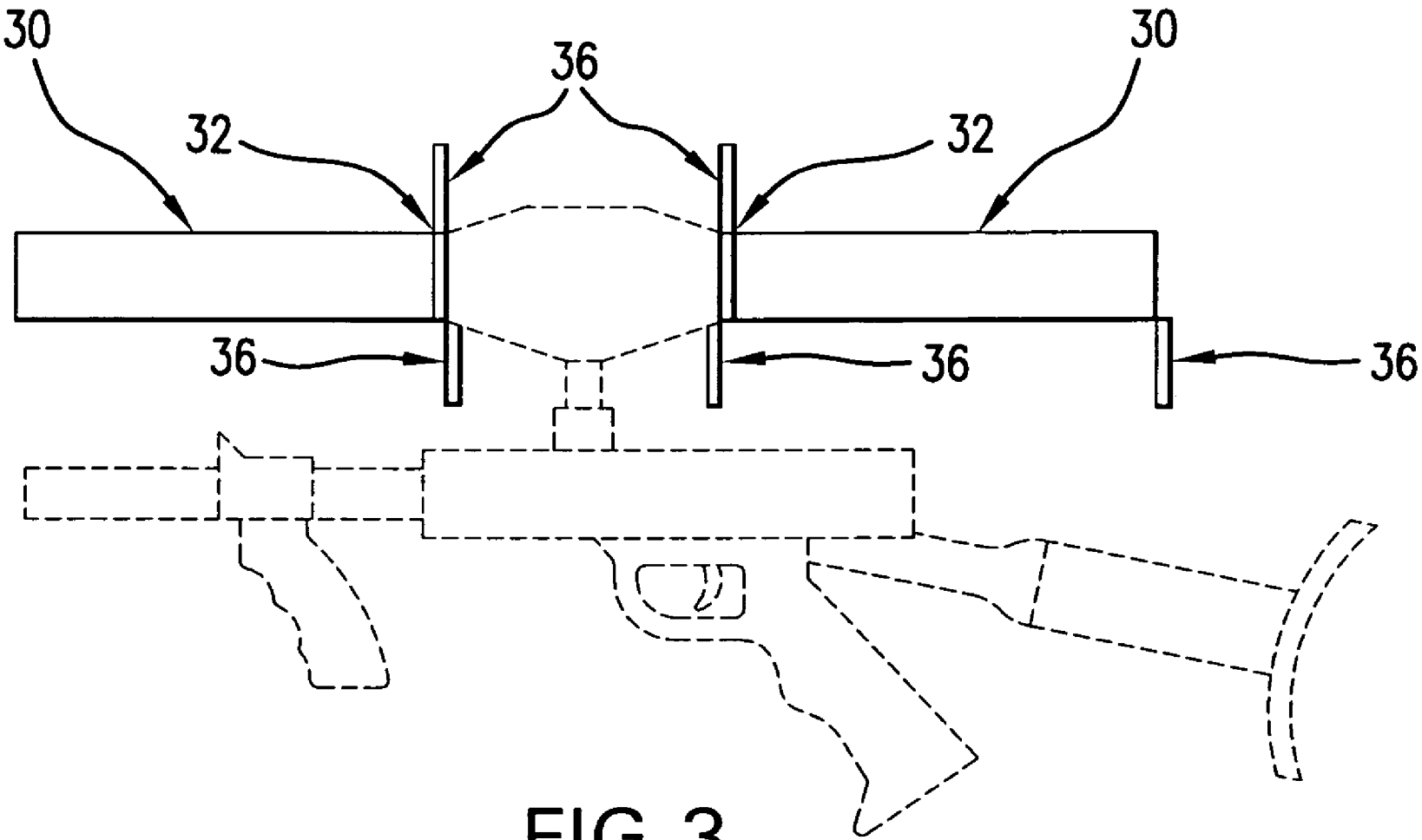
FIG. 3 is an embodiment of the present invention showing a Paintball Gun with a Forward Facing High Capacity Paintball loader at the proximal end of a paintball hopper and a further Rearward Facing High Capacity Paintball Loader at the distal end of a Paintball Feeder Core Egg.

FIG. 3 shows another embodiment of the instant invention showing High Capacity Pod Hopper or Pod Loader housings 30 connected to the proximal and the distal end of a Paintball Feeder Egg housing 46 and said feeder housing with a 'flip' spring loaded retaining enclosure 36.

Figure 4:
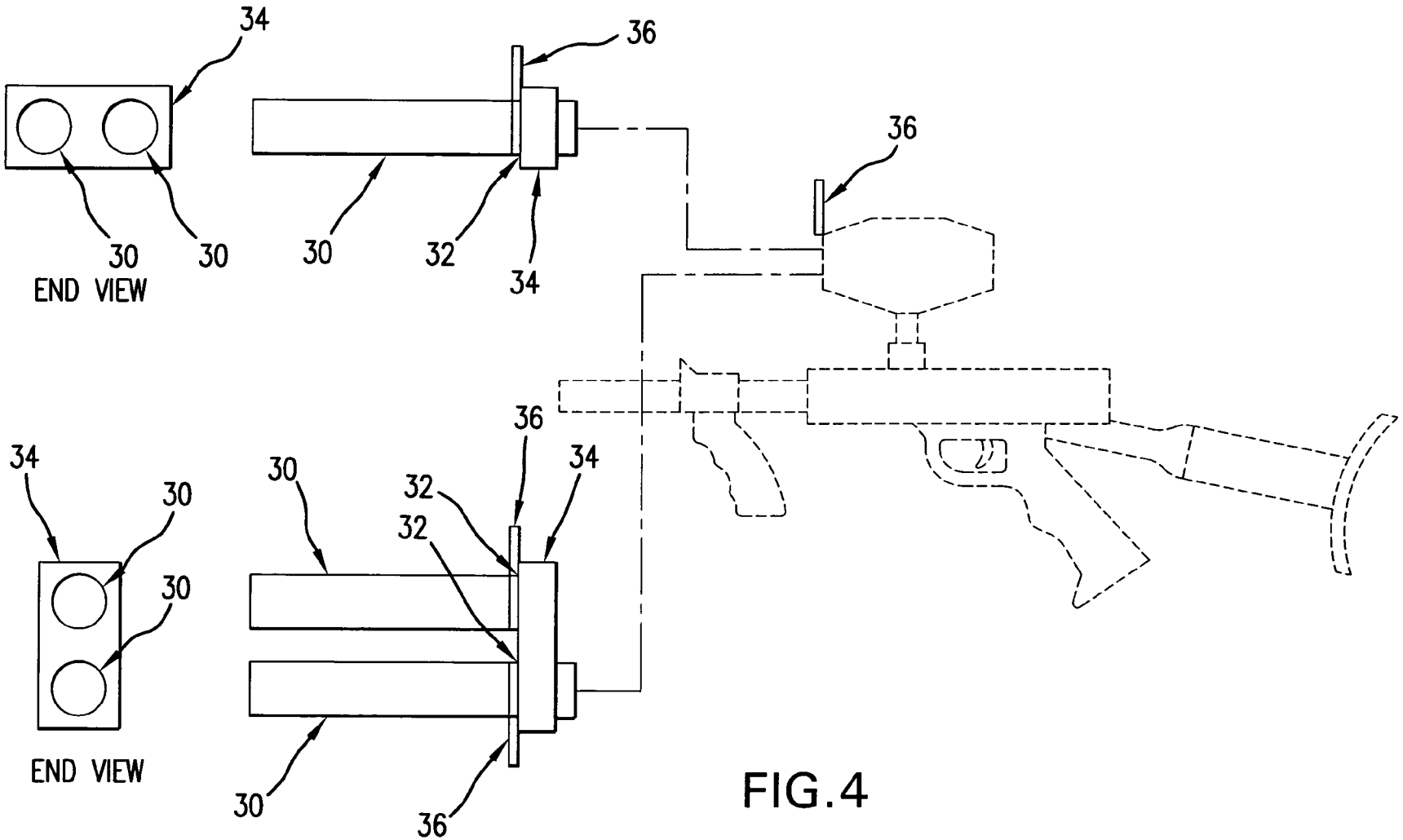
FIG. 4 is an embodiment of the present invention showing a Paintball Gun with two Forward Facing High Capacity Paintball Pod Hoppers or Pod Loaders with an Adaptor piece connected to the proximal end of a Paintball Feeder Core Egg. The Adaptor piece provides a quick turn connector for receiving a Paintball Pod Hopper or Pod Loader housing.

FIG. 4 shows yet another embodiment of the instant invention showing two High Capacity Pod Hoppers or Pod Loader housings 30 connected to an Adaptor piece 34 that is in turn connected to the proximal end of a Paintball Feeder Egg housing 46 with a 'flip' spring loaded retaining enclosure 36. The design of Adaptor 34 enables High Capacity Pod Hopper or Pod Loader housings to be configured in side-by-side or top-to-bottom configurations.

Figure 5:
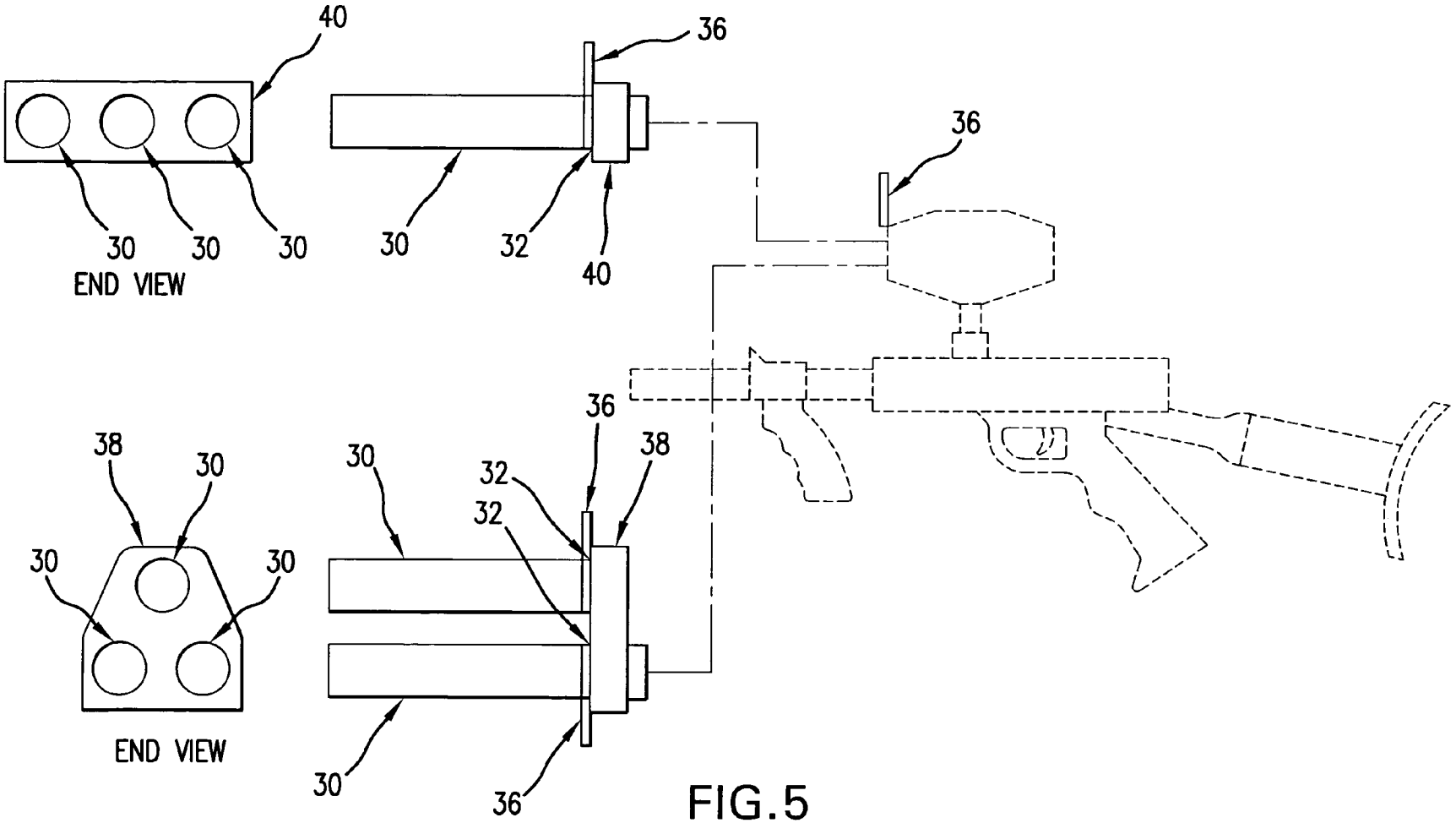
FIG. 5 is an embodiment of the present invention showing a Paintball Gun with three Forward Facing High Capacity Paintball Pod Hoppers or Pod Loaders with Adaptor pieces connected to the proximal end of a Paintball Feeder Core Egg.

FIG. 5 shows an alternate embodiment of the instant invention showing three High Capacity Pod Hopper or Pod Loader housings 30 connected to Paintball Feeder Egg housing in two configurations using Adaptor 38 for a triangular array and alternatively Adaptor 40 for a horizontal array. At each High Capacity Pod Hopper or Pod Loader and Paintball Feeder Egg structure interface a 'flip' spring loaded retaining enclosure 36 is provided.

Figure 6:
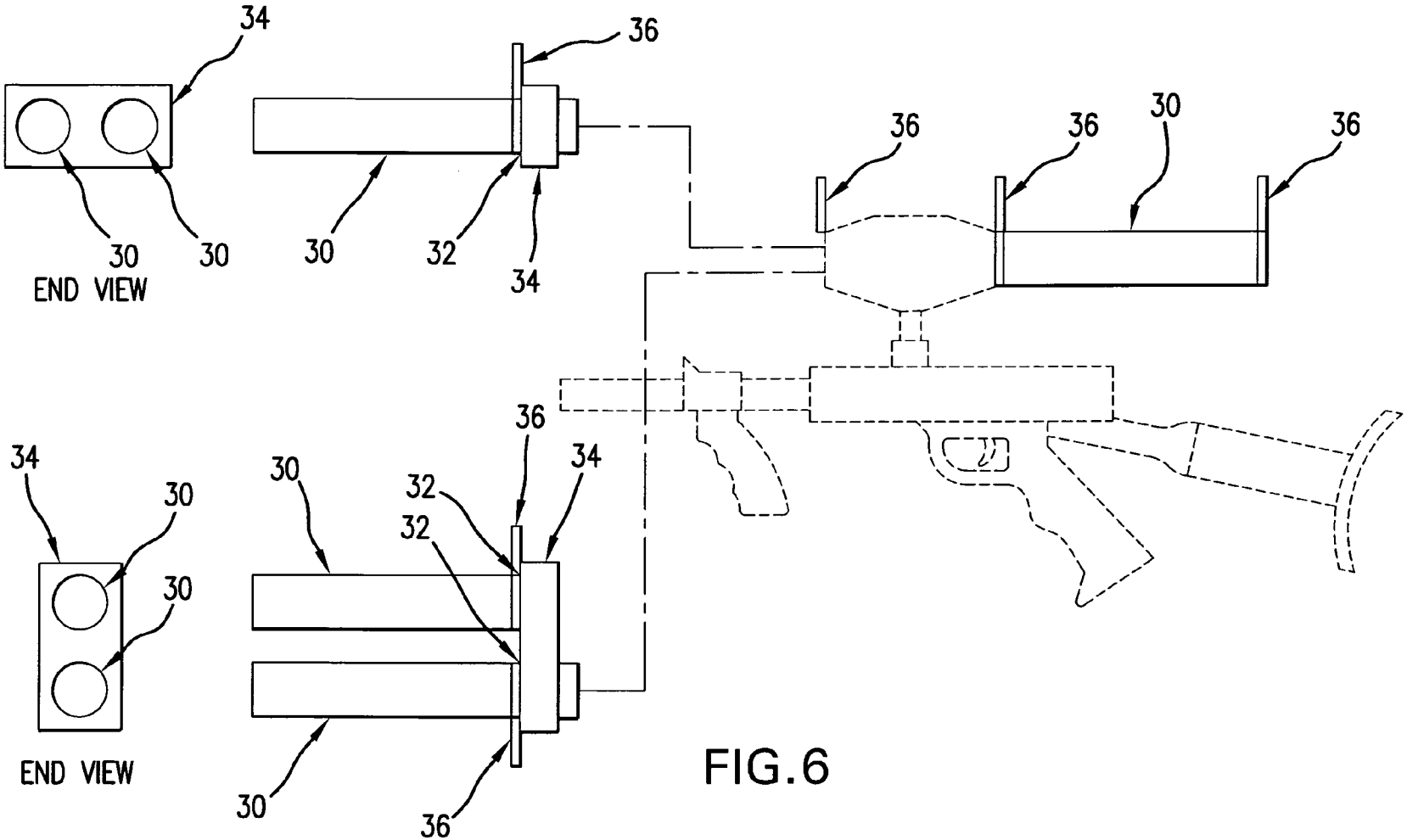
FIG. 6 is an embodiment of the present invention shown in FIG. 4 of a Paintball Gun with two Forward Facing High Capacity Paintball Pod Hoppers or Pod Loaders and a Rearward Facing High Capacity Pod Hopper or Pod Loader connected at the distal end of a Paintball Feeder Core Egg.

FIG. 6 shows another embodiment as a modification to embodiment shown in FIG. 4 with a further High Capacity Pod Hopper or Pod Loader 30 connected to the distal end of the Paintball Feeder Egg housing 46. At each High Capacity Pod Hopper or Pod Loader and Paintball Feeder Egg interface with a 'flip' spring loaded retaining enclosure 36 provided.

Figure 7:
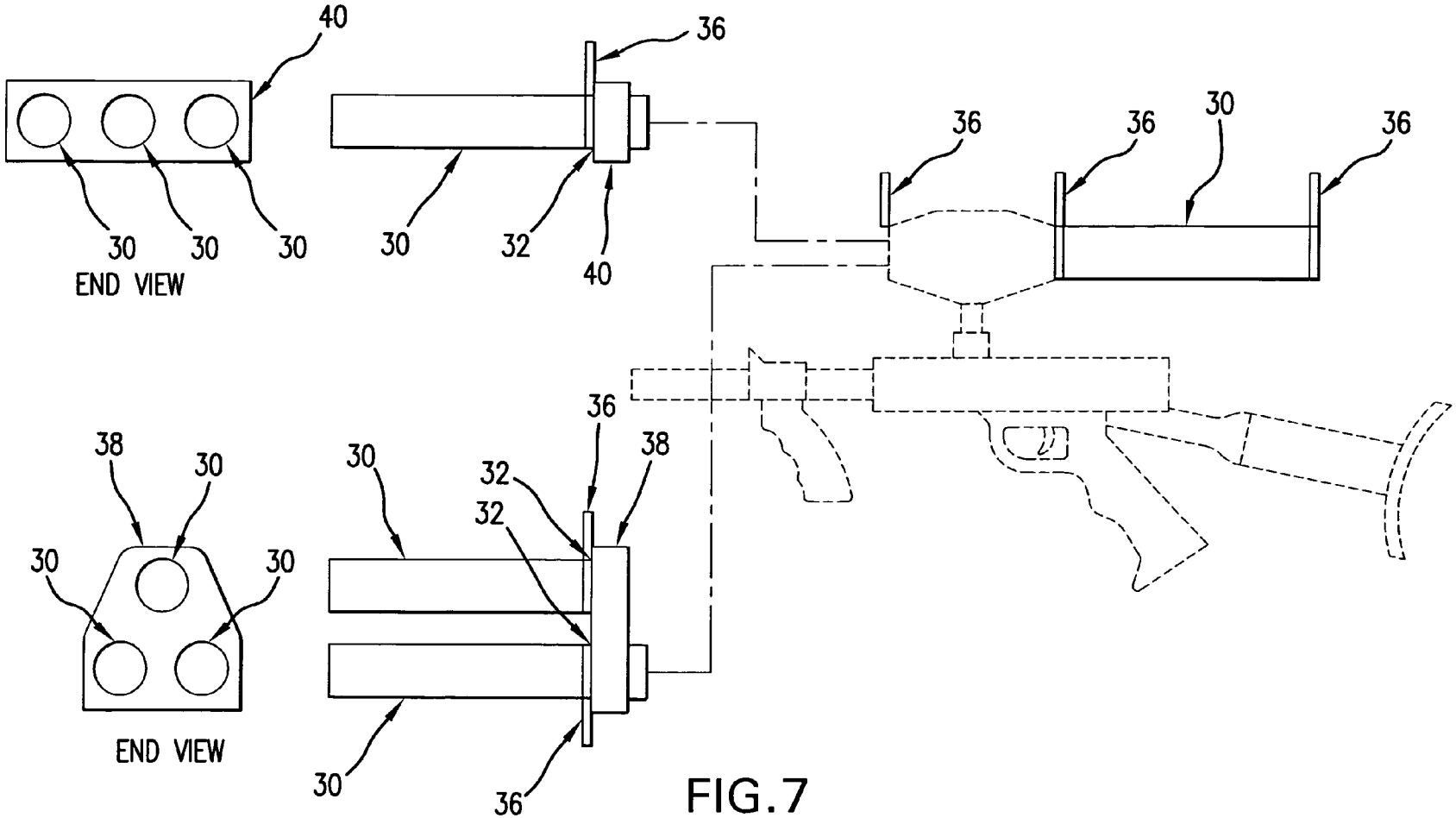
FIG. 7 is an embodiment of the present invention shown in FIG. 5 of a Paintball Gun with three Forward Facing High Capacity Paintball Pod Hoppers or Pod Loaders and a Rearward Facing Capacity Paintball Pod Loader or Pod Loader connected at the distal end of a Paintball Feeder Core Egg.

FIG. 7 shows yet another embodiment as a modification of embodiment shown in FIG. 5 with a further High Capacity Pod Hopper or Pod Loader 30 connected to the distal end of a Paintball Feeder Egg housing 46 with a 'flip' spring loaded retainer enclosure cover. At each High Capacity Pod Hopper or Pod Loader and Paintball Feeder Egg interface, a 'flip' spring loaded retaining enclosure 36 is provided.

Figure 8:
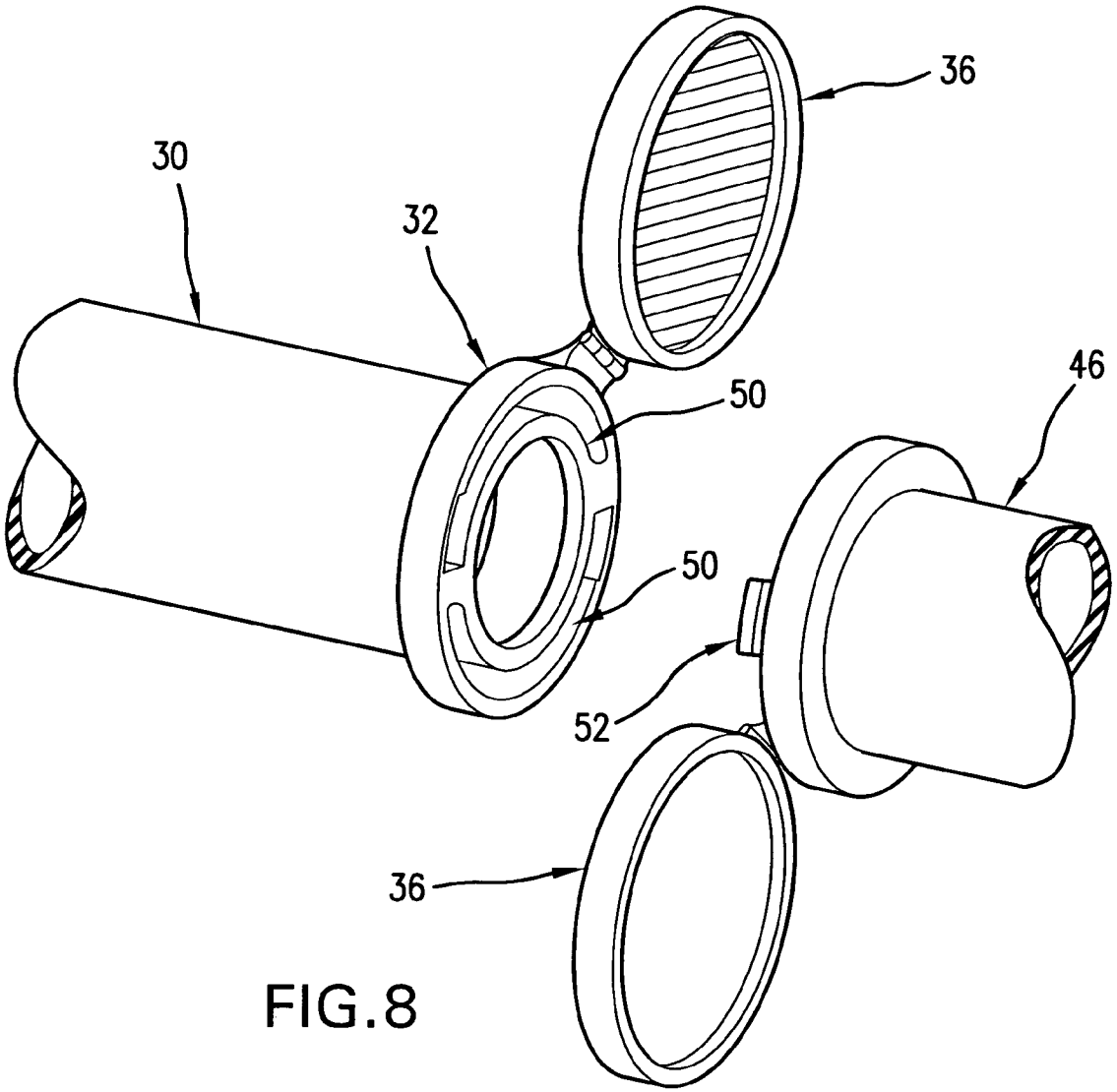
FIG. 8 shows the invention embodiment showing one of a ⅙ turn, ¼ turn, ½ turn and full turn bayonet type connector for connecting High Capacity Pod Hoppers or High Capacity Pod Loaders to one of the proximal and distal ends of a Paintball Feeder Egg and a 'flip' spring loaded retainer enclosure cover.

FIG. 8 shows an embodiment of the instant invention that provides for one of a bayonet type quick-disconnect ⅙ turn, ¼ turn, ½ turn or full turn or equal feature 32 for rapid attachment between the High Capacity Pod Hopper or Pod Loader housing 30 and a Paintball Feeder Egg housing 46 with a 'flip' spring loaded retainer enclosure cover 36 at each of the said high capacity hopper or loader interfaces.

The major feature of the instant invention is a High Capacity Pod Hopper or Pod Loader housing 30 in an elongation shape such as a cylindrical form, oval shape or multi-sided form, such as triangular, square, rectangular, hexagonal, or other number of plane surfaces, wherein the said housing is enclosed at one end and open at the other end to facilitate transfer of paintballs to a feeder hopper attached to the top of a paintball gun. The said loader is capable of being connected to existing types of Paintball Feeder Eggs to provide immediate increased capacity of paint balls and significantly the said high capacity pod hopper and pod loader housing 30 can be arranged in a variety of configurations to provide multiple High Capacity Pod hopper or Pod Loaders 30 to provide even more paint ball capacity. The existing Paintball Feeder Egg mechanisms are cited by reference herein, U.S. Pat. No. 5,816,232—Bell, U.S. Pat. No. 5,722,383—Tipp Mann Sir et al, U.S. Pat. No. 5,736,720—Bell et al, U.S. Pat. No. 5,954,042—Harvey, U.S. Pat. No. 6,109,252—Stevens, U.S. Pat. No. 6,502,567—Christopher et al, U.S. Pat. No. 6,591,824—Hatcher, U.S. Pat. No. 6,725,852,—Yokota et al, U.S. Pat. No. 6,739,323—Tipp Mann Jar, U.S. Pat. No. 7,021,302—Webmaster et al, and GB 2322438—Stevens.

The said high capacity pod hopper or pod loader 30 is provided with a 'flip' spring loaded enclosure cover 36, and the said paintball feeder egg connection is also provided with a 'flip' spring loaded cover 36 at opposing ends to receive the said high capacity loaders 30 as shown in FIGS. 2-8. In the case where the said high capacity pod hopper or pod loader is configured at the rearward distal end of the said paintball feeder egg housing, the said hopper or loader is arranged with an additional 'flip' spring loaded enclosure cover 36 at the distal end of the said high capacity pod hopper or pod loader 30 to facilitate paint ball loading operations. An alternative embodiment of the instant invention provides for the said pod end to be sealed by a breakable seal, such as plastic or metallic foil, that is broken by the action of the twisting operation of the said bayonet type quick connector.

The means of connecting the said high capacity pod hopper or pod loader housing 30 to the said paintball feeder egg housing 46 an be accomplished in a variety of methods, such as but not limited to, fixed glue bonding, ring clips with mechanical fasteners, and quick connect one of a ⅙ turn, ¼ turn, ½ turn or full turn bayonet type or equal fittings 32.

The said quick connect fitting 32 can be arranged in several forms one of which can take the form with a pair of arcuate shaped locking grooves 30 on the surface attached to the said high capacity pod hopper or pod loader 50 and associated locking lugs 52 on the surface attached to the paintball gun feeder egg structure 46 as shown for example in FIG. 8.

For those embodiments utilizing a plurality of the said high capacity pod hoppers or high capacity pod loaders 30, the instant invention makes use of a variety of Adaptor fittings 34, 38, 40 to facilitate connection between the proximal and distal ends of the said paintball feeder egg 46, and for example, in the case of Adaptor 34, this can be used in a vertical or a horizontal configuration.

It will be obvious to one of ordinary skill in the paintball art that the arrangement whereby the said high capacity pod hoppers or pod loaders 30 are configured with multiple units at the proximal end of the paintball feeder egg 46, will serve to improve the paintball shooters aim and accuracy by off-setting the unbalanced load for the gas firing tank cylinder 43 and the said high capacity pod hoppers and pod loaders 30 by better distributing the paintball gun assembly weight.

FIG. 9 shows a typical example of a paintball gun assembly 220 with a hopper housing 120 and alternate feeders 124,126 mounted on top, a loading cover 122, and with an attached gas firing cylinder 280.

FIG. 10 shows an embodiment of the instant invention showing said high capacity pod hopper or pod loader housing 100 integrally connected to the proximal end of said paintball feeder egg housing with permanent connection 130, and a 'flip' spring loaded retaining enclosure 122.

FIG. 11 shows another embodiment of the instant invention showing the said high capacity pod hopper or pod loader housings 100 integrally connected to the proximal and the distal end of a said paintball feeder egg structure housing 26 with permanent connection 130, and a 'flip' spring loaded retaining enclosure 122.

FIG. 12 shows yet another embodiment of the instant invention showing an Integral High Capacity Hopper Combination based on paintball gravity feed concept.

FIG. 13 shows a typical 'flip' spring loaded retaining enclosure 140.

FIG. 14 shows a typical stirring arm type prior art paintball feeder mechanism.

FIG. 15 shows a novel paintball feeder mechanism based on a rotary paddle concept.

FIG. 16 shows a novel paintball feeder mechanism based on a vibratory funnel concept.

The major feature of the instant is a range high capacity pod hopper and pod loader housing 100 designs in an elongation shape such as a cylindrical, oval form or other multi-sided form wherein the said housing is enclosed at one end and integrally connected to a paintball feeder egg structure housing at the other end to facilitate transfer of paintballs to a paintball gun. The said high capacity pod hopper or loader can connected by quick connect bayonet fittings or permanently connected to existing types of paintball feeders eggs to provide increased capacity of paint balls. The said high capacity pod hopper or pod loader housing 100 can be arranged in a variety of integrally connected configurations to provide multiple housings 100 to provide even more paint ball capacity.

The said high capacity pod hopper or pod loader 100 is provided with a 'flip' spring loaded enclosure cover 140, at one of the opposing ends to receive the said high capacity paintballs as shown in FIG. 11

The means of permanently integrally connecting the said high capacity pod hopper or pod loader housings 100 to the paintball feeder egg housing 120 can be accomplished in a variety of methods, such as but not limited to, fixed glue bonding, sonic welding, brazing, thermal bonding, integrally molded, etc.

A further embodiment of the present invention is shown in FIG. 12 wherein the said high capacity pod hopper or pod loader is permanently connected with a paintball feeder egg in the form of a combination unit 300. This unit has a 'flip' type spring loaded enclosure cover 310. In the integral combination unit 300, the said paintball feeder egg is in the form of an element in split halves to facilitate the maintenance of the rotary paddle assembly and to provide for dc. battery cell replacement.

The embodiment shown in FIG. 12 has alternative paintball feeder egg mechanisms as shown for examples in FIGS. 14 and 15. Both these said feeder concepts employ electrical power supplies to drive paddle type stirrers or vibratory funnels.

It will be obvious to one of ordinary skill in the paintball art that the arrangement whereby the said high capacity pod hopper or high capacity pod loaders 100 are configured with multiple units at the proximal end of a paintball feeder egg 120, will serve to improve the paintball shooters aim and accuracy by off-setting the unbalanced load for the gas firing tank cylinder 280 and the high capacity loaders 100 by better distributing the paintball gun assembly weight.

The present invention addresses significant problems that participants in paint ball games face with limited capacity feeder hopper capacities and rapid fire semi-automatic paintball guns that limit the period of time when the player is in the game due to having to stop and frequently re-load the hopper housing from re-supply cylinders carried in separate back-packs.

The instant invention overcomes these disadvantages by providing one or more integral high capacity loaders that can dispense 200 plus paintballs per housing thereby significantly extending the number of paintballs per loading.

The integral paintball loader and hopper combination may be of various lengths and shapes to accommodate the selected users.

It is therefore believed that the operation and construction of the present invention will be apparent from the foregoing specification, drawings and description. It should be noted that while the apparatus shown and described herein characterize preferred embodiments, it will be clear that various changes and modifications could be made without departing from the scope of the described instant invention, and that such equivalents and modifications should be considered to fall within the scope of the following claim.

The present invention addresses significant problems that participants in paint ball games face with limited capacity feeder hopper capacities and rapid fire semi-automatic paintball guns that limits the period of time when the player is in the game due to having to stop and frequently re-load the hopper housing from re-supply cylinders carried in separate back-packs.

The instant invention overcomes these disadvantages by providing additional High Capacity Pod or Pod Loaders that in combination configurations can dispense 50 plus, 100 plus, 200 plus, 300 plus, 400 plus or upwards of 600 paintballs thereby the number of such high capacity pod hopper and pod loader configurations can make available a large number of paintballs thereby significantly extending a players participation and enjoyment in the paintball games.

The said high capacity pod hopper or pod loader may be of various lengths and shapes to accommodate the selected users, such as small, medium, and large sizes, for example, small sizes can be sized to receive 50 plus paintballs, medium sizes can be adapted to receive 100 plus paintballs, and large sizes can be sized to receive 200 plus paintballs.

It will be apparent from the foregoing disclosure that the present invention incorporates a plurality of advantages and points of novelty with respect to prior art for paintball gun feeder egg designs in for examples as follows:

A range of the "Pinokio" series of high capacity pod hoppers and high capacity pod loaders housings readily attachable to existing prior art paintball feeder egg structures providing additional paintball capacities of 50 plus, 100 plus, 200 plus.

The "Pinokio" series of high capacity loader housings holding between 100 plus and upwards of 200 paintball have overall dimensions in the range of 2.00 to 3.50 ins (5.08 to 9.0 cms) diameter by 7.5 to 20.00 ins (19.00 to 50.00 cms) long. The shape of the said high capacity pod hoppers or high capacity pod loaders can be provided in oval shapes and in multi-sided shapes such as triangular, square, rectangular, hexagonal, etc.

The "Pinokio" series range of high capacity pod hopper and pod loader housings can be made from a plurality of materials, such as from high tensile strength plastics, hi-impact plastic, carbon fibers, glass reinforced plastics, or combinations thereof.

The "Pinokio" range of high capacity pod hoppers or pod loader housings can be provided in the form of translucent material, opaque material and with ribbed, raised or facetted surfaces in circular dimple or other geometric shapes for improved handling.

The instant invention of high capacity pod hopper or high capacity pod loader housings constitute a universal fit and can be uniquely retrofitted to existing prior art paintball feeder egg designs.

The aerodynamic configurations of the instant invention does not effect paintball gun function or feel by for example finely balancing the additional weight of the high capacity pod hoppers or high capacity pod loaders by the weight of the compressed power cylinders. The said aerodynamic configuration embodies an angular disposition of the said high capacity pod hopper or pod loader in the range of an angle relative to the paintball gun barrel of between 10 and 15 degrees to improve the line of sight vision of the gun. p1 The instant invention provides for a range of Adaptor pieces designed to accommodate a plurality of high capacity pod hoppers or high capacity pod loader housings in a variety of configurations to provide paintball capacities of 500 plus as compared with existing prior art paintball feeder egg capacities.

In the instant invention it is disclosed for example, in FIG. 12 depicts a single High Capacity Hopper housing permanently connected to an existing prior art Paintball Feeder Egg arranged for gravity feed and fits all paintball guns and an overall capacity of 380 paintballs, in FIG. 10 depicts a single High Capacity Loader housing permanently connected to a power force paintball feeder egg with an overall capacity of 380 paintballs with a feed rate of about 15 balls per seconds, and FIG. 11 depicts a plurality of High Capacity Loader housings permanently connected to a power force paintball feeder egg with an overall capacity of 560 paintballs with a user interface regulator for a feed rate between 24 to 35 balls per second.

The high capacity pod hopper or high capacity pod loader housings of the instant invention can be arranged for a range of connections such as for example, quick release connectors using a variety of bayonet type connectors, permanently connected by a plurality of means such as gluing, sonic welding, thermal bonding, etc, and integral construction with the paintball feeder egg wherein the feeder egg portion is arranged in two halves to facilitate the maintenance of the feeder motor and power cell battery replacement.

The high capacity pod hopper housings of the instant design can be arranged with existing paintball feeder egg prior art using gravity feed and power operated paddle wheel feed configurations.

The high capacity pod loader housings of the instant design can be arranged with existing paintball feeder egg prior art using power operated paintball feeders, such as paddle wheel feed configurations, to provide feed speed settings.

It is therefore believed that the operation and construction of the present invention will be apparent from the foregoing specification, drawings and description. It should be noted that while the apparatus shown and described herein characterize preferred embodiments, it will be clear that various changes and modifications could be made without departing from the scope of the described instant invention, and that such equivalents and modifications should be considered to fall within the scope of the following claims

What is claimed is:

1. A high capacity pod hopper apparatus for supplying paintballs to a paintball gun having a gravity fed paintball feeder core egg housing attached on top of the said paintball gun, comprising:

the said paintball feeder core egg comprising a spring loaded closure paintball loading cover;

a high capacity removable pod hopper housing located at adjacent to at least one of the front proximal end and rear distal end of the said paintball core egg housing for storing a plurality of paintballs, the said removable pod hopper housing having an enclosed end and an outlet opening;

the said outlet opening being provided with removable spring loaded enclosure cover;

the said removable pod hopper housing is capable of being connected to at least one of the front proximal end at least one of the rear distal end of a paintball feeder egg housing whereby the said stored paintballs are readily transferable by gravity to the paintball firing chamber;

a quick connect bayonet type apparatus for removably connecting said paintball hopper housing to said feeder core egg housing;

the said high capacity pod hopper housing and said feeder core egg housing can accommodate a selection range of 100 plus, 200, 300, or 400 plus paintballs, and, wherein an Adaptor piece is provided to accommodate a plurality of the said high capacity pod hopper housings in double and triple configurations.

2. The apparatus of claim 1, wherein the Adaptor piece can be provided to accommodate a number of configurations, such as two or three of the said high capacity hopper housings in a side-by-side or top-to-bottom, and triangular configurations.

3. The apparatus of claim 1, wherein the said high capacity removable pod hopper housings constitute a universal fit and which are attachable to existing prior art paintball feeder core egg housings.

4. The apparatus of claim 3 wherein the high capacity pod hoppers are arranged for quick connections to the said paintball feeder egg housing, are selected to be one of/1;6 turn, ¼ turn, ½ turn or full turn bayonet and an equal type mechanical connector.

5. The apparatus of claim 1, wherein the high capacity pod hopper housings are arranged in aerodynamic configurations that do not affect the paintball gun function or feel by finely balancing the additional weight of the said high capacity loader housings by off-setting the weight of the paintball gun power gas cylinder.

6. The apparatus of claim 1, wherein the material for the said high capacity pod hoppers and said Adaptors can be selected from materials, such as plastic, fiber glass, carbon fiber, aluminum or other types of material that have high tensile strength and light weight.

7. A high capacity pod loader apparatus for supplying paintballs to a paintball gun having a paintball power force fed feeder core egg housing attached on top of the said paintball gun, the high capacity pod loader comprising:

the said paintball feeder core egg comprising a spring loaded closure paintball loading cover;

a high capacity removable pod loader housing located on to at least one of the front proximal end rear distal end of the said paintball feeder egg housing for storing a plurality of paintballs, the said removable pod loader housing having an enclosed end and an outlet opening;

the said outlet opening of the pod loader provided with removable spring loaded enclosure cover;

the said removable pod loader housing is capable of being connected to at least one of the front proximal end at least one of the rear distal end of a paintball feeder egg housing whereby the said stored paintballs are transferable to the paintball firing chamber from the egg feeder housing by power means;

a quick connect bayonet type apparatus for removably connecting said paintball loader housing to said feeder egg housing;

the said high capacity pod loader housing can accommodate a selected range of 100 plus, 200, 300, or 400 plus paintballs, and, wherein an Adaptor piece is provided to accommodate a plurality of the said high capacity loader pod housings in multiple configurations.

8. The apparatus of claim 7, wherein said an Adaptor piece is provided to accommodate a plurality of the said high capacity loader pod housings in multiple configurations, such as two or three of the said high capacity loader pod housings in a side-by-side or top-to-bottom, and triangular configurations.

9. The apparatus of claim 7, wherein the said high capacity removable pod loader housings constitute a universal fit which are attachable to existing prior art paintball feeder core egg structures.

10. The apparatus of claim 9 wherein the high capacity pod loaders are arranged for quick connections to the said paintball feeder core egg housing, are selected to be one of a/1;6 turn, ¼ turn, ½ turn or full turn bayonet or equal type mechanical connector.

11. The apparatus of claim 7, wherein the said high capacity pod loader housings are arranged in aerodynamic configurations that does not effect the paintball gun function or feel by finely balancing the additional weight of the said high capacity pod loader housings by off-setting the weight of the paintball gun power gas cylinder.

12. The apparatus of claim 7, wherein the material for the said high capacity pod loader and said Adaptor can be selected from materials such as plastic, hi-impact plastic, fiber glass, carbon fiber, aluminum or other equal types of material that have high tensile strength and light weight.

13. A combination high capacity paintball pod loader apparatus and housing and paintball feeder core egg apparatus for power force supply of paintballs to a paintball gun firing chamber comprising:

the said paintball feeder egg apparatus comprising a feeder core egg housing with a spring loaded closure paintball loading cover;

said pod loader apparatus with pod loader housing for storing a plurality of paintballs, the pod loader housing having a first enclosed end and an opposite end;

the said pod loader housing integrally connected to the said paintball feeder egg housing whereby the said stored paintballs are readily transferable from the pod loader housing to the feeder core egg housing and from the feeder egg housing to the paintball firing chamber by a power means;

wherein the said power means is in the form of a rotary paddle type feeder mechanism that propels the paintballs from the feeder core egg housing to improve the transfer of paintballs from the feeder core egg housing to the paintball firing chamber, and, wherein the combination high capacity paintball loader housing and paintball feeder core egg housing are provided for supplying paintballs to a paintball gun, and wherein the said paintball feeder core egg housing is in the form of an element in split halves to facilitate the maintenance of the rotary paddle assembly and to provide for a power supply, such as a d.c. battery cell replacement.

14. The apparatus of claim 13, the said high capacity paintball pod loader housing and the paintball feeder core egg housing for supplying paintballs to a paintball gun has a capacity upwards of 600 paintballs.

15. A paintball gun apparatus with a plurality of high capacity pod loader housings are secured to the proximal end and distal end of a paintball feeder core egg housing for supplying paintballs to any existing prior art paintball guns, and said paintball feeder egg housing arranged for mechanical force feeding of paintballs to a paintball firing chamber and regulated at a selected range of between 15 and 100 balls per second, and wherein each of the said high capacity loader housing can accommodate a selected range of 50 plus, 100 plus, or 200 plus paintballs, and wherein the material can be selected from materials, such as, plastic, fiber glass, carbon fiber, aluminum, that have high tensile strength and light weight, and further wherein the connections for the said pod loaders to the said paintball feeder core egg are quick fit mechanical attachment mounts in the form of a spring-loaded pin.

16. The apparatus of claim 15 wherein the connections for the said pod loaders to the said paintball feeder core egg are in the form of one of /1;6 turn, ¼ turn, ½ turn and full turn bayonet quick fit connectors.

17. A paintball hopper for supplying paintballs to a paintball marker, said hopper comprising:

(a) a core egg housing having a forward portion, a rear portion, a top portion and a bottom portion, and, wherein said top portion exhibits a loading port with a sufficiently large opening to permit paintball rounds to be loaded into said core egg housing, and, wherein said bottom portion exhibits a cylindrical discharge neck that is dimensioned to connect to an inlet port of a paintball marker and to discharge paintballs from within said core egg housing into said marker, and, wherein said forward portion exhibits a first matable connector and a forward core egg opening configured to mate with a removable reservoir;

(b) a first removable reservoir having (i) a forward end extending along a forward axis, (ii) a rear reservoir opening configured to close said forward core egg opening and (iii) a second connector that is matable to said first connector along a rear axis, whereby said removable reservoir can be releasably attached to said core egg housing and provide a first reservoir volume for paintballs to be discharged from said core egg housing.

18. The hopper of claim 17, wherein said loading port is closable with a cover.

19. The hopper of claim 18 wherein said cover further includes a biased hinge.

20. The hopper of claim 17 wherein said core egg housing further includes an electrically powered drive to force paintballs from within said core egg housing into said discharge port.

21. The hopper of claim 20 wherein said electrically powered drive comprises an electrically powered, rotating paddle that propels the paintballs from the feeder core egg housing into the paintball firing chamber.

22. The hopper of claim 17 wherein said hopper holds 200 paintballs.

23. The hopper of claim 17 wherein said hopper holds 300 paintballs.

24. The hopper of claim 17 wherein said hopper holds 400 paintballs.

25. The hopper of claim 17 wherein said first matable connector and said second matable connector mate and connect with a biased connection.

26. The hopper of claim 17 further comprising a second removable reservoir having: (i) a forward end extending along a forward axis for a distance greater than said first removable reservoir, (ii) a rear reservoir opening configured to close said forward core egg opening and (iii) a second connector that is matable to said first connector along a rear axis, whereby said second removable reservoir can be releasably attached to said core egg housing in place of said first removable reservoir volume and provide a second reservoir volume having a total volume greater than said first reservoir volume for paintballs to be discharged from said core egg housing.

27. A paintball hopper kit for supplying paintballs to a paintball marker, said hopper comprising:

(a) a core egg housing having (i) a forward portion, (ii) a rear portion, (iii) a top portion, (iv) a bottom portion, and (v) an electrically powered drive disposed in said bottom portion and configured to force paintballs from within said core egg housing into a discharge port, and, wherein said top portion exhibits a loading port with a sufficiently large opening to permit paintball rounds to be loaded into said core egg housing, and, wherein said bottom portion exhibits a cylindrical discharge neck that is dimensioned to connect to an inlet port of a paintball marker and to discharge paintballs from within said core egg housing into said marker, and, wherein said forward portion exhibits a first matable connector and a forward core egg opening configured to mate with a removable reservoir;

(b) a first removable reservoir having (i) a forward end extending along a forward axis, (ii) a rear reservoir opening configured to close said forward core egg opening and (iii) a second connector that is matable to said first connector along a rear axis, whereby said removable reservoir can be releasably attached to said core egg housing and provide a first reservoir volume for paintballs to be discharged from said core egg housing; and (c) a second removable reservoir having: (i) a forward end extending along a forward axis for a distance greater than said first removable reservoir, (ii) a rear reservoir opening configured to close said forward core egg opening and (iii) a second connector that is matable to said first connector along a rear axis, whereby said second removable reservoir can be releasably attached to said core egg housing in place of said first removable reservoir volume and provide a second reservoir volume having a total volume greater than said first reservoir volume for paintballs to be discharged from said core egg housing.

* * * * *